United States Patent [19]

Shemitz et al.

[11] Patent Number: 4,881,156

[45] Date of Patent: Nov. 14, 1989

[54] ADJUSTABLE MOUNTING DEVICE FOR A LUMINAIRE

[75] Inventors: Sylvan R. Shemitz, Woodbridge; Theodore Lepak; Steve Smith, both of Meriden, all of Conn.

[73] Assignee: Sylvan R. Shemitz Associates, Inc., West Haven, Conn.

[21] Appl. No.: 53,045

[22] Filed: May 22, 1987

[51] Int. Cl.[4] ..... F21V 3/02

[52] U.S. Cl. ..... 362/220; 362/287; 362/260; 362/147; 362/429

[58] Field of Search ..... 362/220, 287, 432, 429, 362/147, 151, 153, 260, 418, 430

[56] References Cited

U.S. PATENT DOCUMENTS

| | | | |
|---|---|---|---|
| 12,795 | 5/1908 | Beuttell . | |
| 2,032,791 | 3/1936 | Cartun | 176/29 |
| 2,905,809 | 9/1959 | Pascucci | 240/51.11 |
| 2,922,029 | 1/1960 | Eschelbach et al. | 362/151 |
| 3,138,418 | 6/1964 | Dazley et al. | 362/260 |
| 3,265,886 | 8/1966 | Wigert | 240/51.11 |
| 3,955,078 | 5/1976 | Eggers | 240/52 |
| 4,161,019 | 7/1979 | Mulvey | 362/260 |
| 4,177,504 | 12/1979 | Henderson, Jr. | 362/282 |
| 4,245,284 | 1/1981 | Moore | 362/311 |
| 4,320,885 | 3/1982 | Kawazoe | 248/222.1 |
| 4,368,506 | 1/1983 | Rapp | 362/147 |
| 4,480,809 | 11/1984 | Healey | 248/185 |
| 4,535,393 | 8/1985 | Aspenwall | 362/260 |

FOREIGN PATENT DOCUMENTS

| | | | |
|---|---|---|---|
| 2113817 | 8/1983 | United Kingdom | 362/287 |

*Primary Examiner*—Ira S. Lazarus
*Assistant Examiner*—Sue Hagarman
*Attorney, Agent, or Firm*—Doreen F. Shulman

[57] ABSTRACT

A mounting device for adjustability and lockability of a reflector within a luminaire and for reduction of dark spots in the lighting pattern of adjacently mounted luminaires. The device includes an elongated reflector, mounting straps which may be inserted into and tightened against the reflector and which receive other components of the device, lampholders which may be connected to the mounting straps, mounting brackets, one arm of which is attached to a surface and the other arm of which may be connected with mounting fulcrum screws to a left end mounting strap, a right end mounting strap, or to the left and right end mounting straps of two adjacently mounted luminaires, and locking clamps which may be connected with orientation locking screws to mounting straps and may be clamped to mounting brackets by tightening the orientation locking screws.

6 Claims, 5 Drawing Sheets

FIG. 3
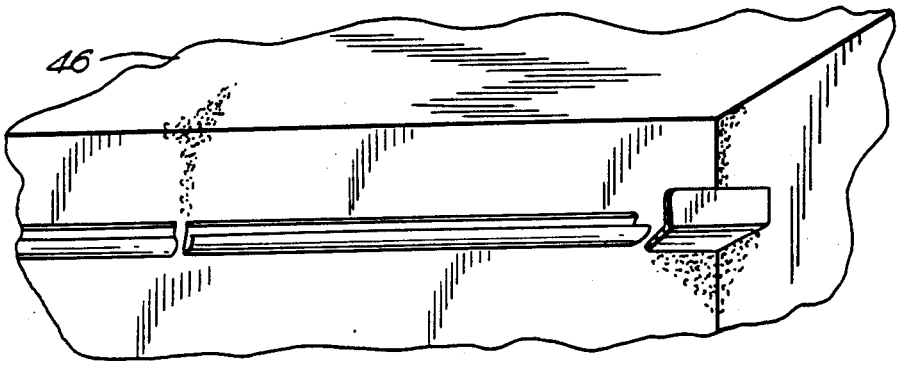
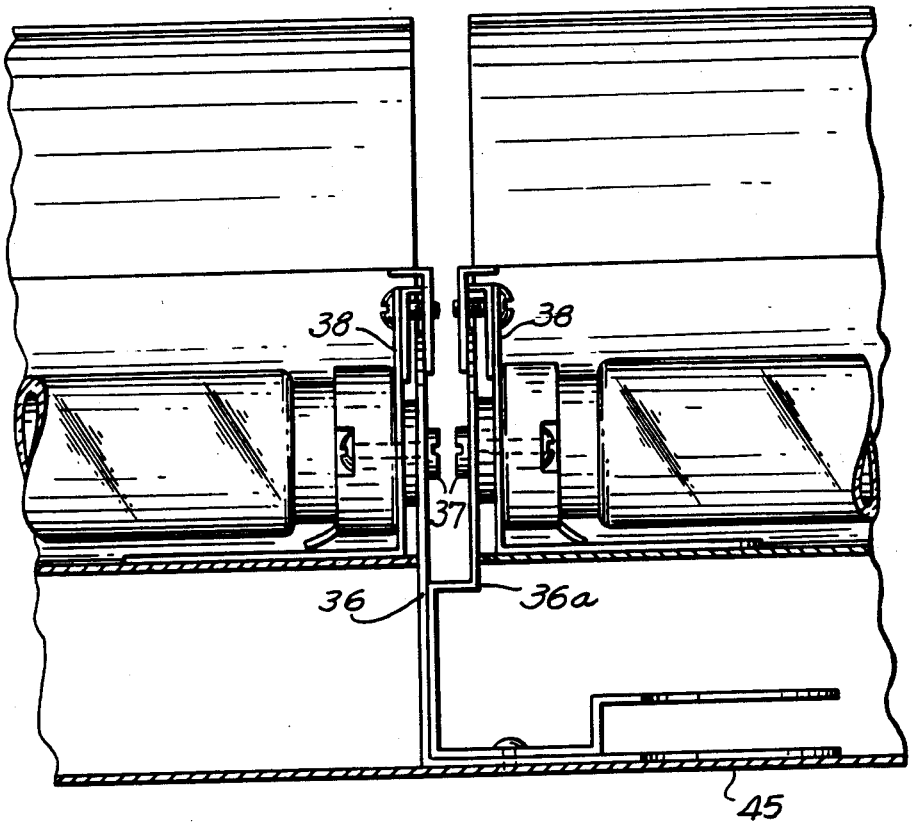
FIG. 4

FIG. 7
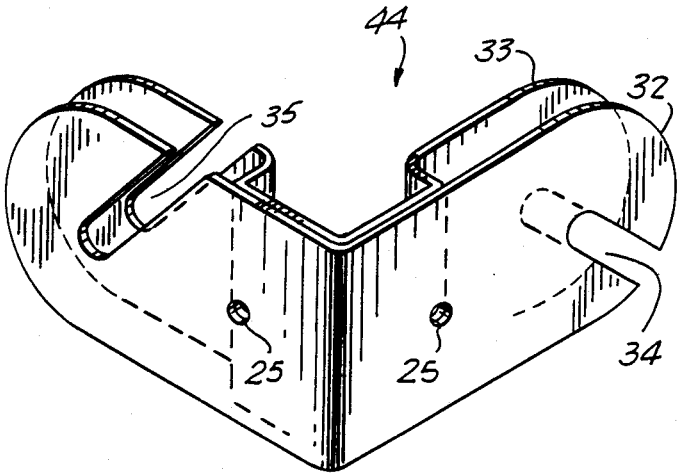
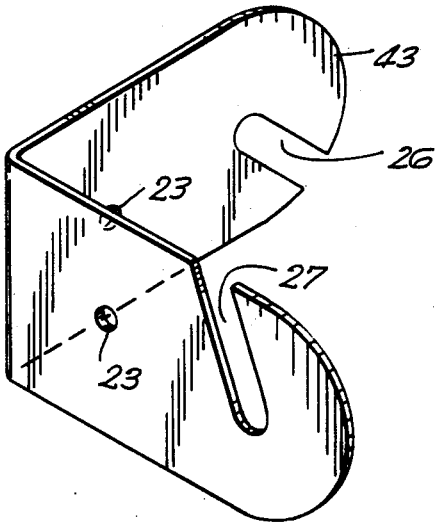
FIG. 8

ADJUSTABLE MOUNTING DEVICE FOR A LUMINAIRE

FIELD OF THE INVENTION

This invention relates to a device for mounting a luminaire to a wall, a ceiling or the top of a ledge near a ceiling.

BACKGROUND OF THE INVENTION

Known apparatus for locking the rotational position of a luminaire about the long axis of an elongated reflector generally include a fulcrum screw or a nut on a fulcrum screw mounted at each end of an elongated reflector coaxially with the long axis of the reflector. The rotational position of the luminaire is locked by tightening the fulcrum screws or the nuts on the fulcrum screws. However, normal luminaire use and vibration sometimes cause such tightening means to become loose and the reflector to rotate out of its desired position.

Additionally, certain lighting applications require luminaires with elongated reflectors to be mounted adjacently, or end-to-end. Such lighting configurations generally result in dark spots in the lighting pattern on the ceiling or wall near the location at which one lamp ends and the adjacent lamp begins. Such dark spots are due to the large end-of-lamp intervals in lighting configurations adjacently mounted with two separate mounting means. The end-of-lamp intervals (space between lighted portions of lamps) in prior lighting configurations are approximately three and one-half inches.

Therefore, there exists a need in the art for mounting apparatus which will allow the rotational position of a luminaire to be locked without subsequent loosening due to normal luminaire use and vibration and which will also allow elongated reflectors to be mounted adjacently with minimal dark spots in the lighting pattern.

SUMMARY OF THE INVENTION

This invention provides a reflector which may be rotated clockwise or counterclockwise about the long axis of the luminaire when the locking clamps are not tightened. Once the reflector is adjusted to its desired position the reflector may be locked into position. The rotational position is locked by tightening the orientation locking screws which cause an L-shaped inner locking clamp and an L-shaped outer locking clamp, by a lever principle, to squeeze the mounting brackets tightly. This locking feature prevents movement of the reflector from its desired position because the tightening pressure points are offset from the long axis of the reflector and the mounting fulcrum screws.

This invention also provides intermediate mounting brackets, one arm of which may be attached to the left mounting strap at the end of one luminaire and the right mounting strap at the end of an adjacent luminaire. These mounting brackets allow luminaires to be mounted adjacently with a significantly reduced end-of-lamp interval (space between lighted portions of lamps). In the embodiment, the depicted interval is reduced from the typical prior art interval of 3½" to an interval of 2". This smaller end-of-lamp interval reduces dark spots in the lighting pattern to nearly imperceptible levels.

It is an object of this invention to provide a mounting device which will lock a reflector into a desired rotational position with no subsequent loosening due to normal luminaire use and vibration.

It is also an object of this invention to provide a mounting device which will reduce the end-of-lamp intervals in adjacently mounted lighting configurations, thereby minimizing dark spots in the lighting pattern.

DESCRIPTION OF THE DRAWINGS

FIG. 3 is a perspective view of two adjacently mounted luminaires with elongated reflectors and the resulting minimal dark spots in the lighting pattern.

FIG. 4 is a front view of two adjacently mounted luminaires, as used with an intermediate mounting bracket, depicting the two-inch end-of-lamp interval.

FIG. 7 is a perspective view of an intermediate mounting bracket.

FIG. 8 is a perspective view of a right end-of-run mounting bracket.

DETAILED DESCRIPTION OF THE PREFERRED EMBODIMENT

Figure 6:
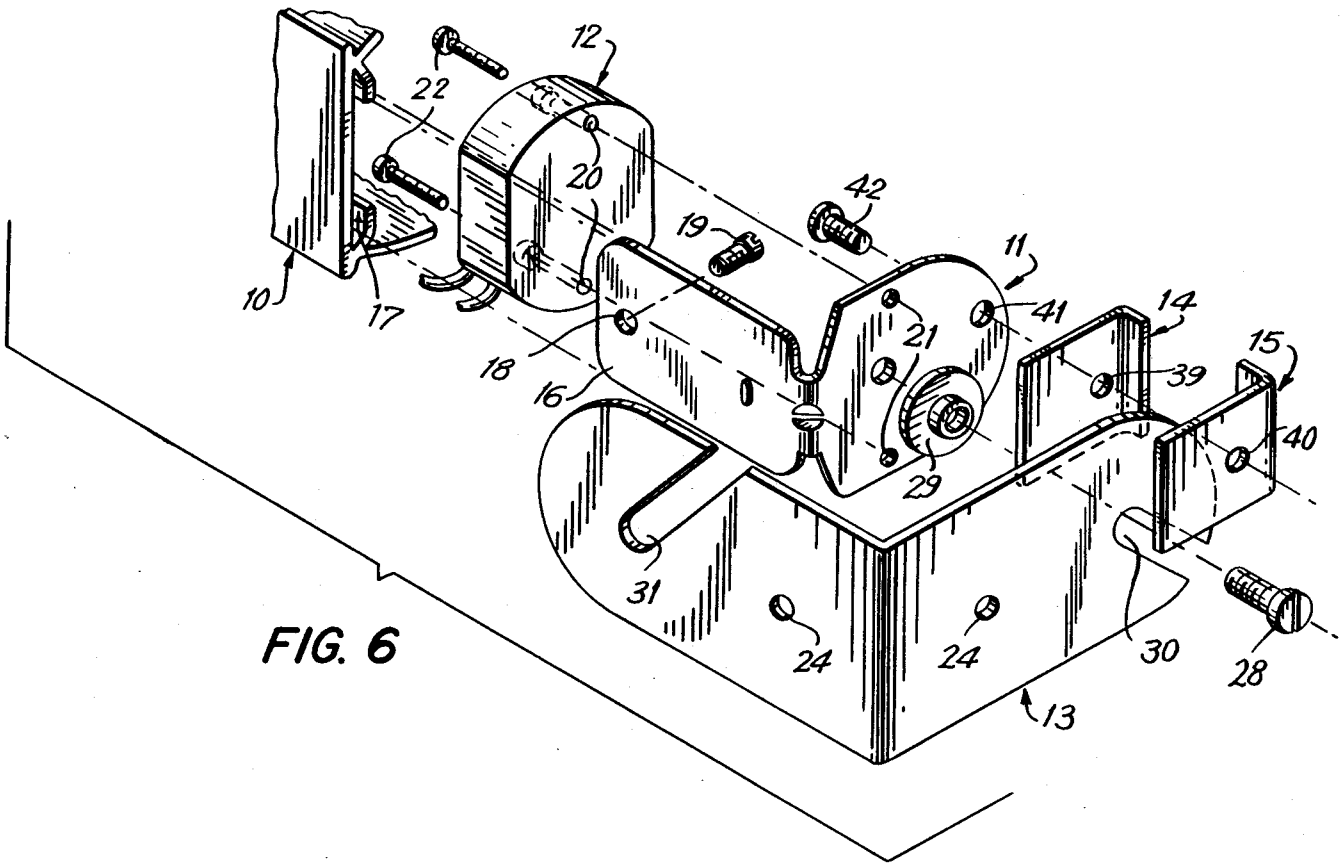
FIG. 6 is an exploded perspective view of the adjustable mounting device as used with a left end-of-run mounting bracket.

The adjustable mounting device of this invention as shown in FIG. 6 comprises a reflector 10, L-shaped mounting straps 11, lampholders 12, mounting brackets 13, an L-shaped inner locking clamp 14 and an L-shaped outer locking clamp 15.

Figure 1:
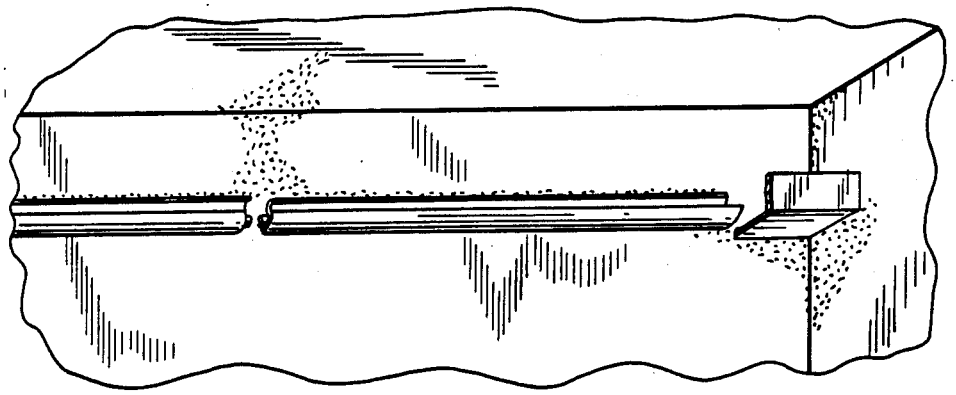
FIG. 1 PRIOR ART
FIG. 1 is a perspective view of two adjacently mounted prior art luminaires with elongated reflectors and the resulting dark spots in the lighting pattern.
Figure 2:
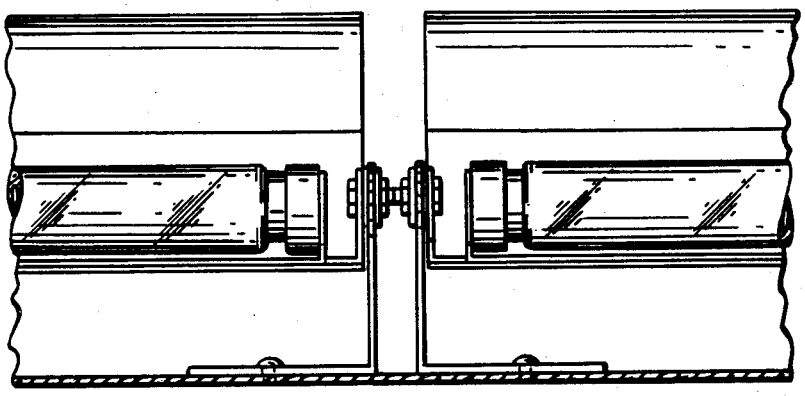
FIG. 2 PRIOR ART
FIG. 2 is a front view of two adjacently mounted prior art luminaires depicting the three-and-one-half inch end-of-lamp interval.
Figure 5A:
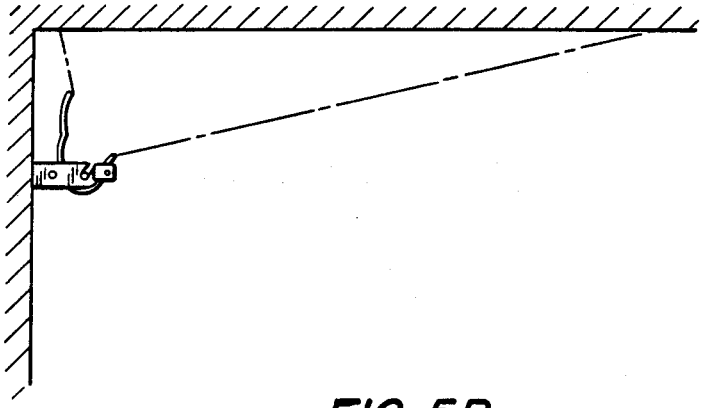
FIG. 5A is a side view of a wall-mounted luminaire illuminating a ceiling.
Figure 5B:
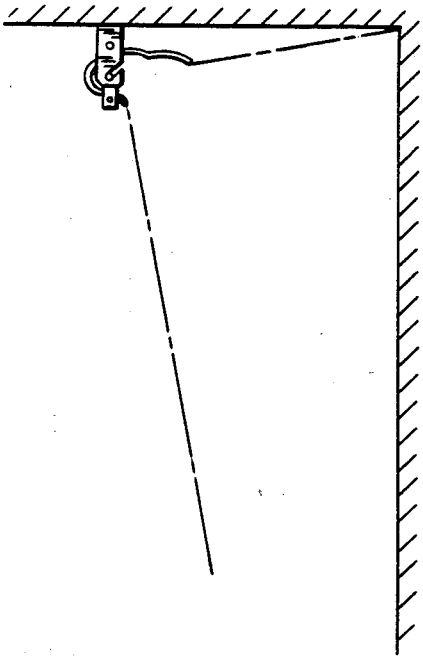
FIG. 5B is a side view of a ceiling-mounted luminaire illuminating a wall.
Figure 5C:
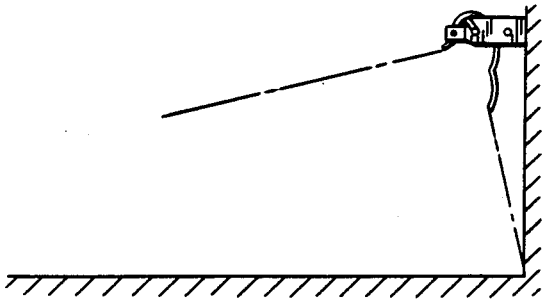
FIG. 5C is a side view of a wall-mounted luminaire illuminating a floor.

FIGS. 5A, 5B and 5C depict typical mounting configurations of a luminaire with the adjustable mounting device of this invention. This invention can be adapted to additional mounting configurations. Whether the brackets are attached to the ceiling, wall, floor or similar surfaces, the installer can orient the brackets so that the luminaire always slides down into the slots 30, 31, 26, 27, 34 and 35, and is retained by gravity.

One arm of each L-shaped mounting strap 16 is inserted into a channel in the reflector 17. Each mounting strap has an opening 18 for receiving a set screw 19 whereby each mounting strap is tightened against the reflector.

Each lampholder 12 has two openings 20 which correspond to two openings in each mounting strap 21 whereby two internal screws 22 are used to connect each lampholder to each mounting strap.

Both arms of the right end-of-run mounting bracket 43, left end-of-run mounting bracket 13 and intermediate mounting bracket 44 have openings 23, 24, 25 whereby one arm of each mounting bracket may be attached to a surface, such as a wall, ceiling, etc.

The right end-of-run mounting bracket 43 has two arms. One arm has a shorter slot 26 which extends radially from the center of curvature at the end of the arm downward to the outer arc. The other arm has a longer slot 27 which extends diagonally upward and intersects beyond the curvature at the end of the arm. Through these slots, one arm of the right end-of-run bracket 43 may be connected with a mounting fulcrum screw 28 and a shoulder washer 29 to the mounting strap 11.

The left end-of-run mounting bracket 13 has two arms. One arm has a shorter slot 30 which extends radially from the center of curvature at the end of the arm downward to the outer arc. The other arm has a longer slot 31 which extends diagonally upward and intersects beyond the curvature at the end of the arm. Through these slots, one arm of the left end-of-run bracket 13 may be connected with a mounting fulcrum screw 28 and a shoulder washer 29 to the mounting strap 11.

The intermediate bracket 44 comprises two nested mounting brackets. The outer bracket 32 is identical to a left end-of-run mounting bracket 13. The inner bracket 33 is nested in and preferably spot-welded to the outer bracket 32, and has two inwardly offset arms which are parallel to the arms of the outer bracket 32. One pair of parallel arms has shorter slots 34 which extend radially from the center of curvature at the end of the arm downward to the outer arc. The other pair of parallel arms has longer slots 35 which extend diagonally upward and intersect beyond the curvature at the end of the arm. Through one pair of these slots 34 or 35, the arms of the intermediate mounting bracket 36 and **36*a* may be connected with mounting fulcrum screws 37 to the mounting straps 38 of two adjacently mounted luminaires, as depicted in FIG. 4**.

The L-shaped inner locking clamps 14 each have an opening 39, and the L-shaped outer locking clamps 15 each have a threaded opening 40 which corresponds to an opening in the mounting straps 41 whereby orientation locking screws 42 are used to connect the inner locking clamps 14 and the outer locking clamps 15 to the mounting straps 11.

Adjustability of the reflector is accomplished when the orientation locking screws 42, inner locking clamps 14 and outer locking clamps 15 are loosened, thereby allowing the reflector to be rotated on the mounting fulcrum screws 28 resting in the slots 30, 31, 34, 35, 26 and 27 of the mounting brackets 13, 44, 43. Once the reflector 10 has been rotated to the position desired, locking is accomplished by tightening the orientation locking screws 42. When these screws 42 are tightened, the inner locking clamp 14 and outer locking clamp 15 cooperate to squeeze the mounting brackets 13, 44, 43 tightly and lock the reflector into position. Because this locking mechanism is offset from the long axis of the luminaire, the reflector may be locked into a desired rotational position with no subsequent loosening due to normal luminaire use and vibration.

Reduction of dark spots in the lighting pattern created by adjacently mounted luminaires is accomplished by use of the intermediate mounting bracket 45 and 44. The nested structure of the intermediate mounting bracket allows two luminaires to be mounted adjacently with a minimal end-of-lamp interval 46 and 45. The small end-of-lamp interval results in the reduction of dark spots in the lighting pattern to nearly imperceptible levels.

We claim:

1. An adjustable mounting device for a luminaire, comprising:

(a) an elongated reflector having a long axis and adapted to receive the adjustable mounting device at each end thereof;

(b) mounting straps attached at each end of the reflector coaxially with the long axis of the reflector;

(c) lampholders attached to mounting straps coaxially with the long axis of the luminaire;

(d) mounting brackets attached at each end of the reflector coaxially with the long axis of the reflector; and (e) locking means, separate from the mounting brackets, attached to mounting straps at each end of the reflector offset from the long axis of the reflector.

2. The adjustable mounting device of claim 1, wherein the mounting straps each further comprises a first arm which is inserted into the reflector and has means for tightening the mounting straps against the reflector, and a second arm perpendicular to the first arm which has means for attaching the mounting straps to lampholders, locking clamps and mounting fulcrum screws.

3. Mounting straps as recited in claim 2, wherein the second perpendicular arm of each mounting strap has;

(a) openings therethrough for passage of internal screws which connect the lampholders to the mounting straps;

(b) an opening therethrough for passage of mounting fulcrum screws which act as pivots for the reflector in the mounting brackets; and (c) an opening therethrough for passage of orientation locking screws which connect the locking means to the mounting straps.

4. The adjustable mounting device of claim 1, wherein the mounting brackets further comprise a right end-of-run bracket and a left end-of-run bracket with arms having diagonal slots at each end to allow for sliding and rotating adjustment of the luminaire.

5. The adjustable mounting device of claim 1, wherein the mounting brackets further comprise intermediate brackets having two nested, parallel arms, each arm having a diagonal slot at each end to allow for sliding and rotating adjustment of two adjacently mounted luminaires.

6. An adjustable mounting device for a luminaire, comprising:

(a) an elongated reflector having a long axis and adapted to receive the adjustable mounting device at each end thereof;

(b) L-shaped mounting straps inserted into the reflector channel, thereby preventing vertical movement of the mounting straps;

(c) lampholders, each having two openings therethrough of preselected diameter for receiving two screws, whereby the lampholders may be connected to the mounting straps;

(d) mounting brackets, each having means for receiving mounting fulcrum screws and shoulder washers, whereby one arm of the mounting brackets may be connected to the mounting straps, and arms of the mounting brackets each having an opening therethrough, whereby one arm of the mounting brackets may be mounted to a surface;

(e) L-shaped inner locking clamps, each having an opening therethrough, and L-shaped outer locking clamps, each having a threaded opening therethrough, whereby the inner and outer locking clamps may be clamped onto the mounting brackets by means of orientation locking screws received by the mounting straps, the inner locking clamps and the outer locking clamps.

* * * * *